US005526790A

United States Patent [19]

Augustin et al.

[11] Patent Number: 5,526,790

[45] Date of Patent: Jun. 18, 1996

[54] FUEL INJECTION SYSTEM FOR AN INTERNAL COMBUSTION ENGINE

[75] Inventors: Ulrich Augustin, Kernen; Volker Schwarz, Weinstadt; Hermann Hiereth, Esslingen, all of Germany

[73] Assignee: Mercedes-Benz AG, Stuttgart, Germany

[21] Appl. No.: 411,277

[22] Filed: Mar. 27, 1995

[30] Foreign Application Priority Data

Apr. 15, 1994 [DE] Germany ..... 44 13 156.9

[51] Int. Cl.[6] ..... F02M 41/00

[52] U.S. Cl. ..... 123/456; 123/506

[58] Field of Search ..... 123/458, 456, 123/506, 198 DB

[56] References Cited

U.S. PATENT DOCUMENTS

| | | | |
|---|---|---|---|
| 2,863,437 | 12/1958 | Bessiere . | |
| 3,762,379 | 2/1973 | Hobo et al. . | |
| 4,300,509 | 11/1981 | Schechter | 123/456 |
| 4,422,420 | 12/1983 | Cromas | 123/458 |
| 4,459,963 | 7/1984 | Gross | 123/506 |
| 4,610,233 | 9/1986 | Kushida | 123/458 |
| 5,109,822 | 5/1992 | Martin | 123/456 |
| 5,168,855 | 12/1992 | Stone | 123/456 |
| 5,191,867 | 3/1993 | Grassey | 123/456 |
| 5,201,294 | 4/1993 | Otsuka | 123/458 |
| 5,230,613 | 7/1993 | Hilsizos | 123/456 |

FOREIGN PATENT DOCUMENTS 3536828 4/1987 Germany .

OTHER PUBLICATIONS

ATZ/MTZ Sonderheft Motor und Umwelt, Special Issue 1992 p. 28 "Fuel Injection for Diesel Engine" by Toshihiko Omori.

*Primary Examiner*—Carl S. Miller
*Attorney, Agent, or Firm*—Klaus J. Bach

[57] ABSTRACT

In a fuel injection system for an internal combustion engine having a high-pressure pump supplying fuel from a low pressure fuel supply conduit connected to the pump to a common high pressure fuel supply conduit for the injectors of the internal combustion engine via a high-pressure conduit extending between the high pressure pump and the common fuel supply conduit, the high-pressure conduit includes a non-return valve which, at the same time, is operable electromagnetically so as to be capable of maintaining the non-return valve open beyond the high-pressure pump delivery stroke for the release of fuel from the common fuel supply conduit under the control of the pump plunger and for rapid pressure relief by keeping the non-return valve open beyond a point at which the plunger opens the low-pressure fuel supply conduit connected to the pump.

3 Claims, 1 Drawing Sheet

FUEL INJECTION SYSTEM FOR AN INTERNAL COMBUSTION ENGINE

BACKGROUND OF THE INVENTION

The invention relates to a fuel injection system for an internal combustion engine, having a high-pressure pump and a common supply conduit (common rail), acting as a pressure reservoir, for magnetic-valve controlled injection nozzles.

A fuel injection system of this type with delivery of the fuel into a high-pressure reservoir is known from the AZT/MTZ special issue of Motor und Umwelt 1992, page 28 ff. "Fuel Injection for Diesel Engine", by Toshihiko Omori. A non-return valve in the high-pressure fuel supply line prevents reverse flow of fuel from the high-pressure reservoir after the delivery phase. A magnetic valve which can be activated as a function of operating parameters of the internal combustion engine is provided downstream of this non-return valve and specifically, in a relief conduit which provides communication between the low-pressure side and the high-pressure fuel supply line. The magnetic valve used in this case provides for a requiremenet-controlled fuel supply during the delivery phase of the high-pressure pump.

SUMMARY OF THE INVENTION

In a fuel injection system for an internal combustion engine having a high-pressure pump supplying fuel from a low pressure fuel supply conduit connected to the pump to a common high pressure fuel supply conduit for the injectors of the internal combustion engine via a high-pressure conduit extending between the high pressure pump and the common fuel supply conduit, the high-pressure conduit includes a non-return valve which, at the same time, is operable electromagnetically so as to be capable of maintaining the non-return valve open beyond the high-pressure pump delivery stroke for the release of fuel from the common fuel supply conduit under the control of the pump plunger and for rapid pressure relief by keeping the non-return valve open beyond a point at which the plunger opens the low-pressure fuel supply conduit connected to the pump.

With the fuel injection system according to the invention a simple control for the fuel supply without the need for additional valves is achieved. The special arrangement and design of the magnetic valve provides for a double-duty function, namely the function as a non-return valve and the function of draining fuel from the common supply conduit in a controlled manner. The non-return valve will open automatically up to the top dead center position of the pump piston and then can be held in the open position for a period, depending on the magnitude of the desired relief stroke, by activating the magnetic valve. Rapid but controlled pressure relief takes place. If the the non-return valve is held open until the supply line opening is freed by the pump piston, pressure in the supply conduit is relieved via the open magnetically held open non-return valve and via the opened fuel supply conduit to the low-pressure side. However, the magnetic valve can also be actuated at the beginning of the delivery phase, that is, during the delivery stroke and thereby provide for a requirement-controlled fuel supply to the high pressure fuel reservoir.

An embodiment of the invention is represented in the drawing and is described in greater detail below with reference to the drawings.

DESCRIPTION OF THE PREFERRED EMBODIMENT

Figure 1:
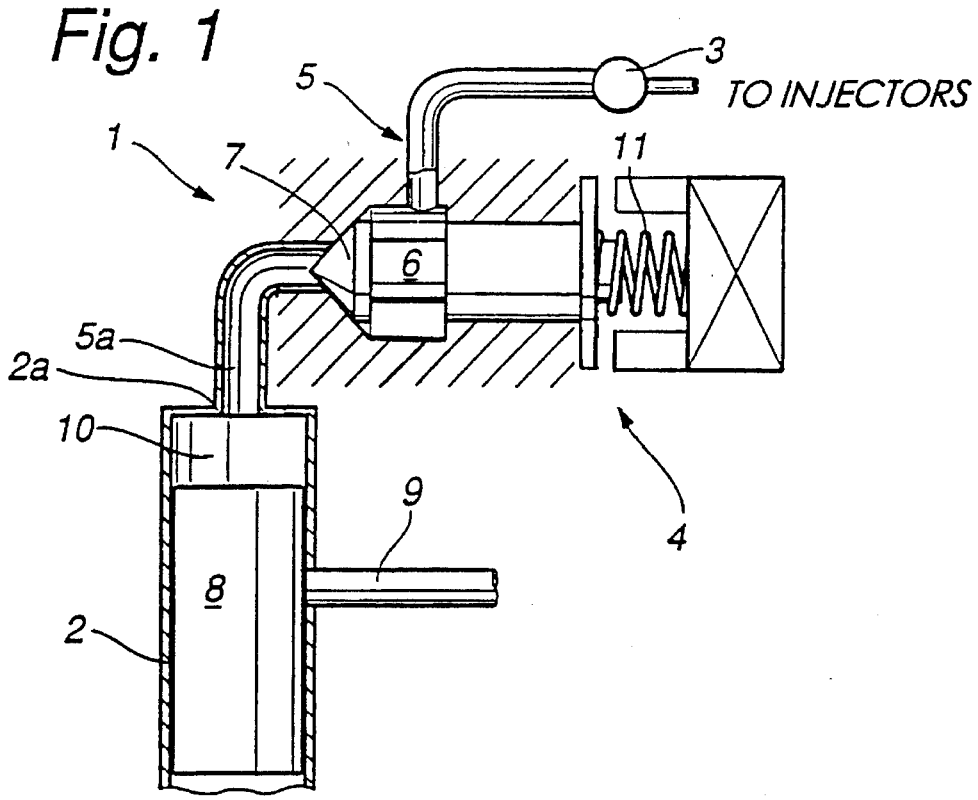
FIG. 1 shows a part of a fuel injection system having a high-pressure conduit, with a magnetic valve arranged between the high-pressure pump and the high-pressure reservoir.

A fuel injection system 1, as shown in FIG. 1, for a multi-cylinder internal combustion engine consists essentially of at least one high-pressure pump 2, which is a cam-actuated cartridge-type pump, a common fuel supply conduit 3—a so-called common rail—provided for supplying fuel to magnetic-valve controlled injection nozzles (not shown) and an electromagnetically actuated control valve 4 in a high-pressure fuel supply conduit 5 connecting the high-pressure pump 2 to the supply conduit 3.

The control valve 4 is provided with a spring-loaded spool 6 having a conical valve tip adapted to close the conduit section 5*a* at the high-pressure pump end of the high-pressure conduit 5.

The high-pressure pump 2 comprises a pump plunger 8 and a pump working space 10, and has connected thereto a low-pressure fuel supply conduit 9.

Figure 2:
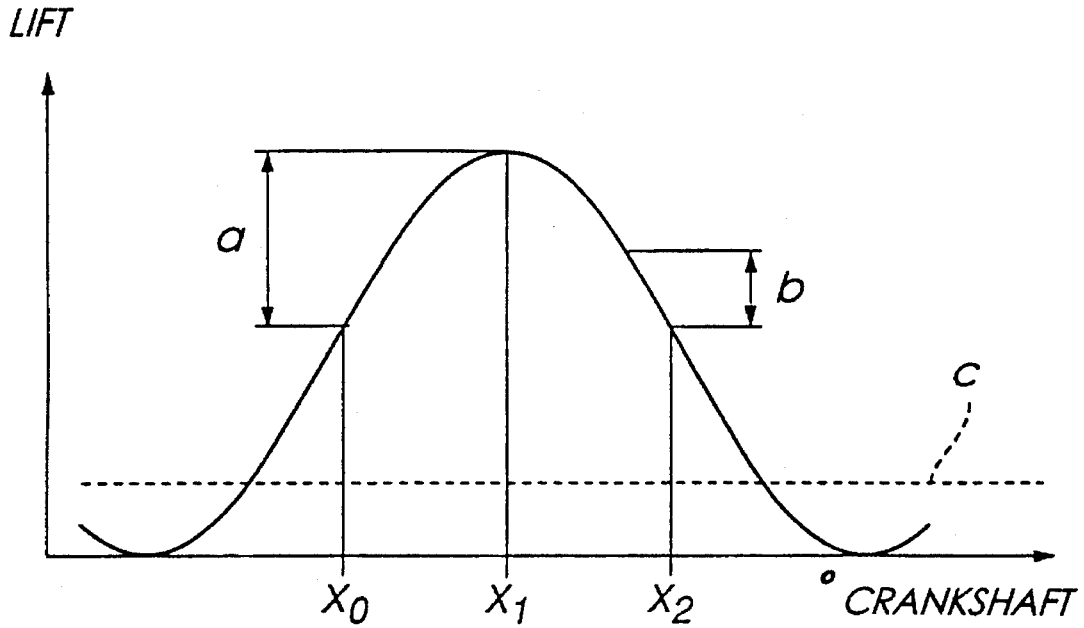
FIG. 2 shows, in a graphical representation, the cam lift plotted against degrees of crankshaft angle.

In the diagram shown in FIG. 2, the stroke of the pump plunger 8 is plotted against degrees of crankshaft angle wherein specifically:

$X_o$=beginning of the delivery stroke $X_1$=top dead center of pump plunger a=the delivery stroke length a–b=the relief stroke length b=the effective delivery stroke length c=the supply conduit opening level $X_2$=the end of the plunger stroke The control valve 4 is arranged in the high pressure conduit 5 which has no connection to the low-pressure side between the outlet end 2*a* of the high-pressure pump 2 and the supply conduit 3. The filling of the pump working space 10 takes place when the low-pressure fuel supply conduit 9 is opened in the retracted position of the plunger 8. As soon as the pump plunger 8 closes off this conduit 9, the delivery phase is initiated at $X_o$. The heretofore seated spool 6 is lifted thereby opening the valve 4 automatically up to the point $X_1$. If the control valve 4 is not activated that is electromagnetically held open when the relief stroke of the pump plunger 8 begins, the spool 6 is moved into the closing position by the spring 11 and the valve 4 acts as a non-return valve. If, on the other hand, the spool 6 is held in the open position past the top dead center of the pump plunger 8 by the electromagnetic structure of control valve 4, the delivery quantity is reduced in accordance with the length of the relief stroke a–b.

The relief or pressure decay in the common rail can be accelerated, particularly in the case of rapid changes of load, by the spool 6 remaining open even in the lower stroke phase of the pump plunger when the fuel supply conduit 9 is opened by the plunger 8 as the working space 10 of the pump then provides for direct communication between the common fuel supply conduit 3 and the low pressure fuel supply conduit 9.

Variable pressure relief in the common supply conduit 3 provided for the injection nozzles is therefore achieved in the simplest manner by the special arrangement and configuration of the electromagnetically actuable control valve 4 which is designed to serve, at the same time, as a non-return valve.

The control valve 4, however, can also be activated in the delivery phase, in order to provide for a requirement-controlled fuel supply.

What is claimed is:

1. A fuel injection system for an internal combustion engine, having a high-pressure pump with pump working space and a common supply conduit acting as a pressurized fuel reservoir for magnetic-valve controlled injection nozzles, a high-pressure conduit extending between said high-pressure pump and said common fuel supply conduit and including a non-return valve adapted to be opened by fuel discharged from said fuel pump during the pump delivery stroke, a low pressure fuel supply conduit connected to said pump for supplying fuel to the pump working space, said non-return valve being operable also electromagnetically for overriding the function of the non-return valve and keeping the non-return valve open for controlled pressurized fuel release from said common supply conduit during the pump relief stroke.

2. A fuel injection system according to claim 1, wherein said non-return valve has a spring-loaded spool and means for holding the spool electromagnetically in its open position beyond the delivery phase of said pump.

3. A fuel injection system according to claim 2, wherein said means for holding said spool electromagnetically in its open position are actuable already during the delivery phase.

* * * * *